US005603502A

United States Patent [19]

Nakagawa

[11] Patent Number: 5,603,502

[45] Date of Patent: Feb. 18, 1997

[54] POKER TOURNAMENT METHOD

[76] Inventor: George Nakagawa, 15404 S. Catalina, Gardena, Calif. 90247

[21] Appl. No.: 559,599

[22] Filed: Nov. 20, 1995

[51] Int. Cl.[6] ..... A63F 1/00

[52] U.S. Cl. ..... 273/292; 273/274

[58] Field of Search ..... 273/274, 292, 273/148 R

[56] References Cited

U.S. PATENT DOCUMENTS 5,451,054 9/1995 Orenstein ..... 273/148 R

OTHER PUBLICATIONS

"Card Player", vol. 8/No. 21, Oct. 20, 1995, pp. 15,28 & 93.

*Primary Examiner*—William M. Pierce
*Attorney, Agent, or Firm*—Chris Papageorge

[57] ABSTRACT

A poker tournament commences with first groups of several or more players playing poker games at different tables. The players are initially provided with a certain number of game chips for use in the games. When players lose their chips, they drop out of the tournament games. When the total number of players remaining in the games declines to a specific number (which is an exponential product of the number two), they are matched up into pairs each playing in individual one-on-one games. The winners of the individual games are rematched with other winners into pairs and this rematching successively continues until one player has won all of the chips in the tournament.

20 Claims, 2 Drawing Sheets

POKER TOURNAMENT METHOD

BACKGROUND OF THE INVENTION

The present invention relates to poker games, and, more particularly, to a method for organizing and conducting a poker tournament so as to enhance spectator involvement in and enjoyment of the tournament.

The card game known today as poker originated in France and later resulted in a Persian card game considered to be the progenitor of modern poker. The Persian game known as "as nas" came into America by way of New Orleans about 200 years ago. Features were added or modified via borrowing from other French and English games resulting in the game in the form in which it is played today. The more popular of the modern poker games utilize seven cards rather than five cards as was popular in the last century, and one contemporary version utilizes thirteen cards.

Some of the more popular versions of poker played in card game casinos are seven card stud, hold-em and Omaha hi-low split. In these and other versions of card games played at casinos, the players typically play against each other with the casino taking a percentage of the pot. However, some card games have been developed in which the players play against the house rather than each other. Such card games have been developed in an effort to provide games which appeal more to the players who, it is believed, prefer to play against the house rather than against other players thereby attracting more players to the casinos. An example of such a card game is disclosed in U.S. Pat. No. 5,382,025 to Sklansky et al in which three or more poker players play against the house and in which incomplete poker hands are dealt face up and in which each player then selects one of the plurality of hands. Each player who bets on the winning hand wins his or her bet.

Other methods for playing card games have been designed for the purpose of increasing player participation in various types of card games and thereby increasing the revenues afforded to the casinos. An example of such a method is disclosed in U.S. Pat. No. 5,401,023 to Wood which discloses a wagering system which affords the player added entertainment by providing the players an opportunity to make choices and select strategy during the course of the game.

Many other types of card games have been designed especially for use in casinos and attempt to increase player interest in and enjoyment of casino card games and thereby attract more players into the casinos and increase the time during which they play games therein in order to increase revenues for the casinos. Some of the ways casinos use to accomplish this is to generally implement the most popular games and to accelerate the rate of play for a particular game. One of the methods specifically designed for accelerating the rate of play of poker is disclosed in U.S. Pat. No. 5,377,973 to Jones. Although many of these poker game methods and apparatuses have succeeded in increasing player participation and casino revenues, they have had little if any success in attracting mass media attention and sponsorship to the poker games.

As the legalization of gambling has become more widespread and as the public has become more drawn to gambling casinos and in particular card game casinos, the Gaming Commissions of many states have also approved the holding of poker tournaments. Casinos typically hold poker tournaments in an effort to attract more card players. The casinos often put their own money into the tournament money pool in order to make the pool very large thereby making the tournaments more enticing for the players. However, the poker tournaments typically require the players to pay the entry fees of the tournaments with their own money. The prize winners typically number three to eight with the higher percentage of the tournament pool being awarded to those who finish highest in the tournament.

Although large tournament pools are effective in luring players, the large number of players at the game tables makes it difficult for the spectator to view and follow the game playing of each player. This makes it more difficult for the spectator to follow the game playing tactics and strategies of every participant at a particular table and therefore makes it more difficult for the spectator to follow the different strategies and game playing skills used in the particular game and thus identify with and root for any particular player. In addition, the large number of players at each table makes it more difficult for television cameras to provide viewing of all the players at a table while also providing viewing of the actions of each individual player. If the television camera switches from one player to another in order to show the game playing actions, methods and perhaps strategy of each participant, it must be done quickly in a fast moving game resulting in inadequate coverage of each player and may thereby appear to be confusing for the observer. In addition, adequate coverage of the actions of each player is made more difficult because oftentimes many of the players at a table will simultaneously place their bets or simultaneously take other action. Due to the typically relatively small screen of a television and the flat image it provides, this makes it difficult for a television to provide a view of such a scene with sufficient detail to enable the viewer to discern the individual actions of each participating player. Thus, viewing such a tournament on a television is apt to be confusing and appear to be a mishmash of player activity that overwhelms the senses. In addition, the large number of players playing a single game at each table slows down each hand. Thus, the relatively slow moving poker games makes viewing of the games sometimes rather boring. In addition, in such poker games, most players do not participate in each hand because they fold early upon seeing that the hand they have been dealt does not look promising. A spectator following the playing actions of particular players is apt to be discouraged from continuing to take an interest in such players when seeing these players fold because of the abrupt cessation of their playing actions and the implication that they are becoming unlucky and apt to start a losing streak. Consequently, the large number of players at each of the game tables is not conducive to attracting a great deal of spectator interest and attention. This prevents the tournaments from enjoying more widespread viewership. In addition, this prevents the tournaments from attracting the attention of sponsors who might otherwise desire to capitalize on the publicity accorded such tournaments by the large amount of money involved and the widespread spectator interest which could be engendered. As a result, such tournaments cannot enjoy the added publicity and widespread viewership that sponsors could provide through, for example, cable television coverage and more widespread advertising of the tournaments. Such sponsorship would be very effective in attracting the interest of prospective players and thereby bring new players into the casinos. Thus, the lack of such sponsorship limits the expansion of the business of poker tournaments and limits the growth of the player and spectator base. In addition, many casinos resist holding such tournaments because they believe that they simply lure card players away from other clubs rather than attracting new card players. Thus, it is commonly believed that such tournaments simply transfer business between casinos instead of bringing new business into the industry as a whole.

What is therefore needed is an improved method for organizing and conducting poker tournaments which facilitates spectator involvement in and vicarious enjoyment of the games. What is also needed is an improved method for organizing and conducting poker tournaments which allows more effective mass media coverage of each individual game thereof in order to allow the spectators to observe the playing actions and methods of each player while devoting adequate time for coverage of each player's actions and behavior to enable the spectator to integrate these observations regarding each individual player into the playing of the game in its entirety and more effectively follow the progress of each individual game thereby promoting spectator involvement in and vicarious enjoyment of the tournament games.

SUMMARY OF THE INVENTION

It is a principal object of the present invention to provide a poker tournament method which allows a spectator to observe a greater percentage of the poker game playing actions and inactions of each player.

It is also an object of the present invention to provide a poker tournament method which enables a spectator to more completely follow the poker game playing actions and inactions of all the players in each particular selected game of the tournament.

It is also an object of the present invention to provide a poker tournament method which which facilitates television coverage of the poker games thereof.

It is also an object of the present invention to provide a poker tournament method which accelerates the rate of play of the games of the tournament.

It is also an object of the present invention to provide a poker tournament method which hastens the conclusion of the games of the tournament.

Essentially, the poker tournament method of the present invention organizes the tournament so that the players are paired up and the pairs are playing individual games. Thus, in the games of the tournament two players play against each other in a match play type of setup. In contrast, in conventional poker tournaments, there are a relatively large number of players playing at each table i.e., playing in each game. In the one-on-one game playing of the tournament, the game action i.e., betting, raising, calling, etc., simply passes back and forth between the two players. Thus, the action of the games is easier to follow for the spectator because there are only two players. The use of only two players also simplifies the action thereby making it easier to follow all the playing actions and inactions of every participant throughout the games. In addition, the rate of play of the games is accelerated relative to conventional poker tournament games and the use of only two players makes each hand conclude more quickly. This has the benefit of bringing the games of the tournament to a conclusion much faster than those of conventional tournaments. In contrast, the games of conventional tournaments tend to be more drawn out making it boring for the spectator and participants alike and making it less likely to hold the attention of the spectator throughout the game playing period of the tournament. Although dedicated poker tournament game spectators would nevertheless watch such games, less dedicated spectators and newcomers to the sport would be unlikely to pay rapt attention to such long and drawn out tournament games. Consequently, the difficulty that tournament games of relatively long duration face in attracting and holding the attention of spectators make it unlikely that live television coverage of the tournament would be viable. Taped television coverage of the event would require extensive editing and condensing of the game playing which would be likely to result in deletion of most of the important action as well. For these reasons, there has not been a significant amount of television broadcasting of such tournaments.

The tournament of the present invention starts out the same as a conventional tournament. All the game participants are given an equal number of game chips. The game participants which typically number between approximately fifty and three hundred are divided up into groups with each of the groups numbering approximately seven to nine so that each game table has a relatively large number of players. Since it is unlikely that there would be much spectator interest at this early stage of the games, relatively large groups are initially used to more effectively weed out the less skilled players who drop out of the games when they lose all their chips. Thus, the game playing at this stage of the games is designed to reduce the number of participants to a smaller number which would be more conducive to attracting spectator interest and involvement.

When the number of participants has dwindled down to a much smaller number, the remaining participants are divided up into pairs. The games are played in a type of match play such that each one of the participants is matched up with and plays against solely another one of the participants. When a player of one of the pair loses all his chips, he drops out of the tournament and the remaining player i.e., the winner, is matched up with a winner from another table. In this type of match play game, both of the participants at each table typically play every hand in contrast to a conventional poker game in which most participants fold early in the hand. Match play makes it more likely a player will call or raise and makes it less likely he will fold or simply take no action if it is not necessary for him to put additional chips in the pot. Consequently, match play makes it more likely that all players will be more active than players at full table play. Thus, there is more action at this type of game which makes it more interesting to watch. In addition, since the participants do more betting because they play generally every hand, the players run out of game chips sooner and the games tend to conclude more quickly. In addition, match play increases the rate of play i.e., the number of hands played per unit of time, because less deliberation time is involved than for players at a full table who choose not to play a particular hand. The games thus have a faster pace which promotes both participant and spectator excitement. In addition, since at this final stage of the games the games are of shorter duration, this stage of match play is more conducive to television coverage thereby providing a wider audience for the tournaments and consequently more avenues for deriving profit from the tournaments. Thus, the game method of the present invention attracts sponsorship of such tournament games who might seek to profit from the wider audience generated therefrom.

The tournament ends when one player (winner) has won all of the chips in the tournament. All monies in the tournament pool are distributed among all players who were remaining in the tournament when match play commenced; the amount that is distributed to each player is dependent upon the players' final placement in the tournament.

DETAILED DESCRIPTION OF THE PREFERRED EMBODIMENT

Figure 1:
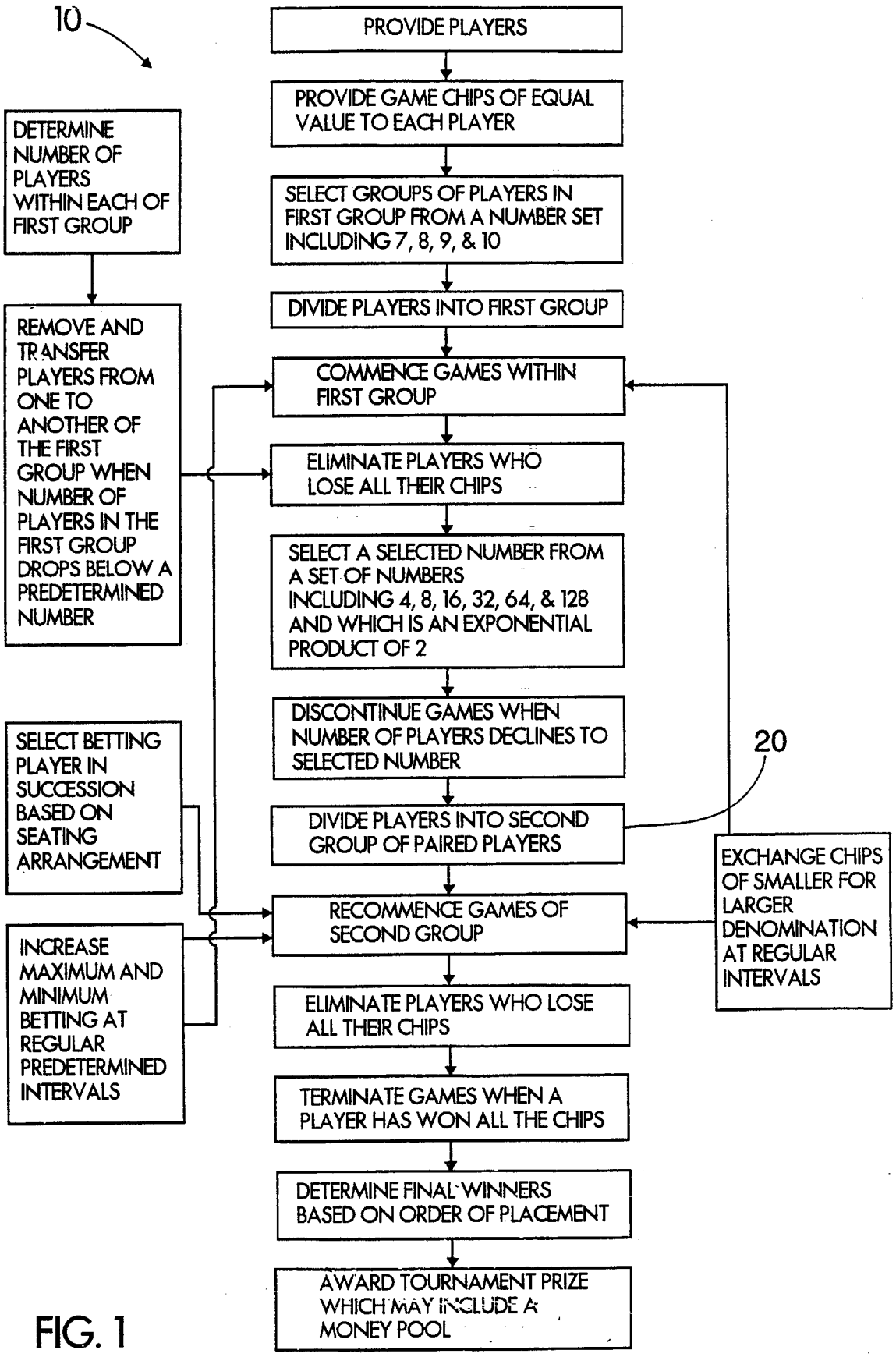
FIG. 1 is a flow chart illustrating the method of organizing and conducting poker tournaments according the present invention.

Referring now to the drawing, the poker tournament method is generally designated by the numeral 10. Initially, a large group of poker players who have paid an entry fee in order to participate in the tournament are gathered together. The poker players i.e., poker tournament participants, are divided up into a set of first groups and provided with game chips. The amount or token value of the game chips of each player are equal in order to equalize every player's chance of winning the tournament. The first groups are preferably seated at selected game tables (and preferably seated at random) with each of the groups at separate tables. There are preferably from seven to ten players at each table. However, this number of players at the tables may be more or less than this number, if desired, and may vary according to the type of poker game to be played.

The casino preferably provides a house dealer for each table who will deal the cards and monitor action at the particular table. The house dealer is not a participant in the tournament.

For tournaments in which a variation of stud poker is played, the first player to act will be the player with the highest card showing or the lowest card showing; this depends on whether the game being played is high poker (highest ranking hand wins the pot) or low poker (lowest ranking hand wins the pot).

For tournaments in which a variation of poker other than stud poker is being played, a "player dealer" will be selected at random for each table prior to the start of the tournament. The "player dealer" will rotate after the playing of each hand. One or two players who are seated to the immediate left of the "player dealer" will be required to make a blind bet i.e., he will be required to make a bet before receiving any cards. The first player to the left of the previous blind bettor may call the blind bet, raise or fold his hand. Thereafter, action passes successively to each player to the left who may also call, raise or fold his hand. The amount of these blind bets as well as betting limits will increase progressively at regular intervals unitl completion of the tournament.

The relatively large number of players at each table makes it probable that each table will have many players of varying degrees of skill and/or luck. This makes the use of a large number of players at each table generally effective in weeding out the poorer players at each table. Since spectators generally have relatively little interest in viewing the initial games since the participants include so many players of poor skill or having bad luck who are typically not interesting to watch, providing a large number of players at each table at the initial stage of the tournament games is unlikely to adversely affect spectator interest or involvement to any significant extent.

The players whose tournament chips dwindle down to zero drop out of the tournament. As the number of players at each particular table diminishes due to the drop outs, the remaining players are transferred to other tables in order to raise the number of players at each table to a generally uniform and relatively high level. This tends to make it more likely that each table has a good mix of players of varying degrees of playing success thereby tending to produce the desired weeding out of the lesser skilled and/or less lucky players. As a result, the winners of the games at the initial stage thereof are probably those with the highest poker playing skills and/or luck and therefore those who presumably are more interesting for the spectators to watch.

Figure 2:
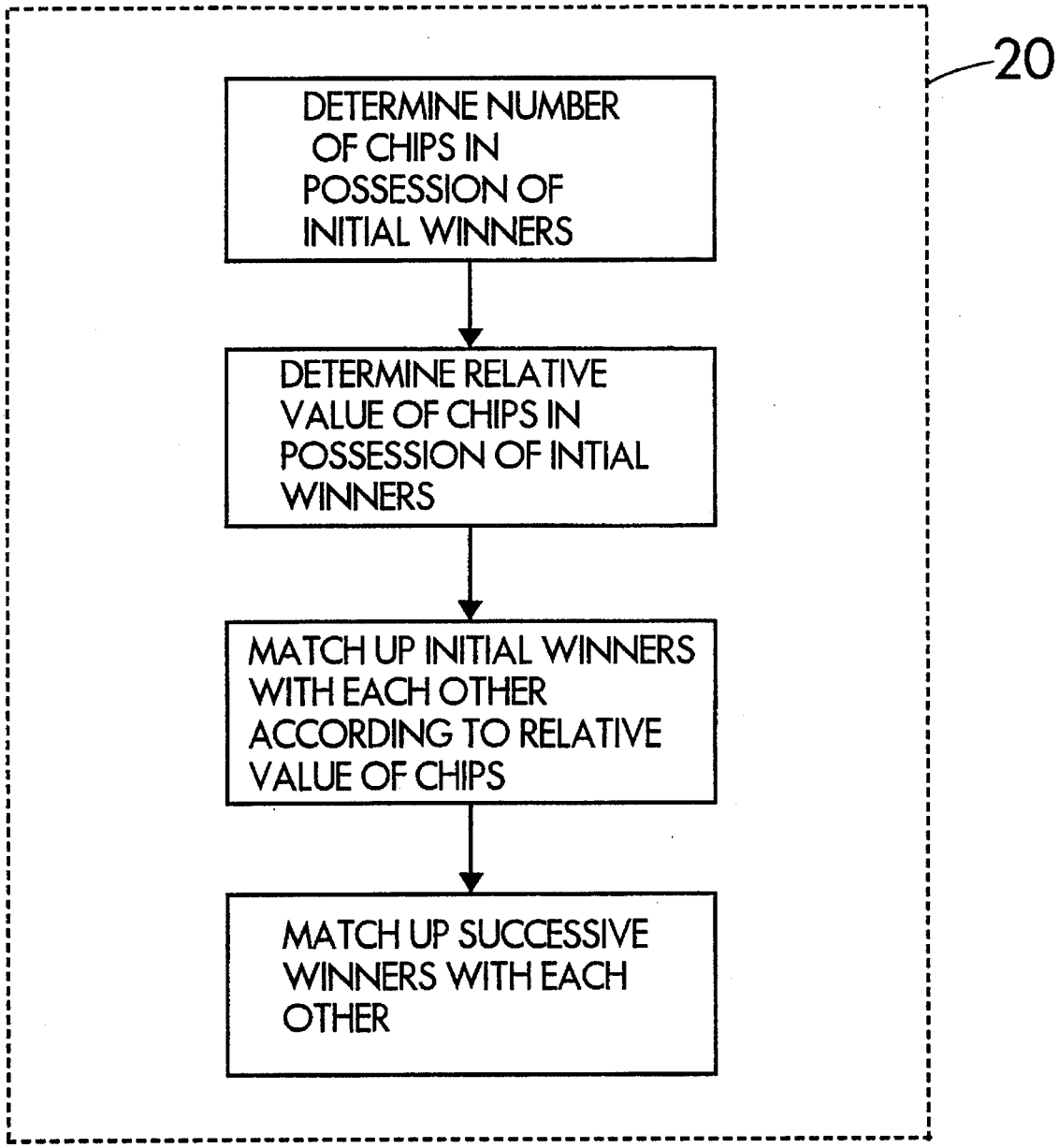
FIG. 2 is a flow chart illustrating the components of one of the steps of the method of the invention illustrated in FIG. 1.

When the remaining players in the tournament dwindles down to a selected number, the first group is disbanded prior to commencement of match play. For the match play part of the tournament, the players are reorganized into a second group in which the players are matched up into pairs with a pair of players at each table. The step of dividing the players into the second group of paired players is generally designated by the numeral 20 and the component steps of this dividing step 20 are shown in FIG. 2. The players who survive to match play are seeded accorded to the number of chips that the player has at the time that match play begins. For example, the player with the largest number of chips will be matched against the player with the smallest number of chips, the player with the second largest number of chips will be matched against the player with the second smallest number of chips, etc. The players who are the favorites of the spectators i.e., the players who are typically the most successful in the tournament, are the ones with the greatest number (or value) of chips at the end of the initial rounds of match play. The most favorite players are matched against the least favorite players to make it more likely that the more favorite players will win out in the match play. Since the spectators often root for and vicariously play along with the most favorite players, match play will thus enhance spectator interest and involvement. The winners of these match play games are thus likely to be those players who draw the most spectator interest and involvement. The selected number at which the remaining players are reorganized into the second group is preferably either two hundred and fifty-six, one hundred and twenty-eight, sixty-four, thirty-two, sixteen or eight or four. These numbers are selected as those which allow the second group to be further subdivided into pairs so as to ultimately result in two players who have won all the chips. These two players play against each other in the championship finals of the tournament. Thus, the initial winners of the individual games are rematched up into other pairs of players and successive winners are subsequently rematched up into successive matched pairs of players until one player has won all the chips. The selected number is thus an exponential product of the number two (representing the last pair of final winners). The selected number is also based on the total number of players at the commencement of the games such that the higher the number of players at the commencement of the games the higher the selected number thereby resulting in a higher number of match play players. The players advancing to match play competition retain all the chips in their possession at the end of the previous round of game play.

The dealers deal some of the cards face up and others face down in accordance with the type of card game played. For example, in a "Holdem" type of poker game, each player is dealt, face down, a hand consisting of two cards. After an ensuing betting round, the dealer turns face-up three communal cards known as the "Flop". Another betting round follows, and the dealer turns face-up one more communal card. After the next betting round, the dealer turns face-up the last of the five communal cards. After a final betting round, the winning players are determined by comparing the best five card hand each player can make using their own personal two card hand in conjunction with any three of the five communal cards. Conventional poker rank is used to compare the hands of the players. The pot of each individual game is awarded to the winning player or split among two or more winning players who possess poker hands of equal rank. However, the pot may be split differently than this depending upon the particular type of "Holdem" game played. The particular type of game played may also be any of various poker games (or any other type of suitable card game). The match game method of the present invention is particularly well suited for limit poker which provides a fast paced, action packed game that is more effective in attracting and keeping the attention of spectators.

In order to facilitate completion of the tournament within a reasonable timeframe, minimum and maximum bets are raised at regular intervals throughout the tournament. In addition, the chips accorded each player are preferably chipped up i.e., relatively small denomination chips are substituted periodically with relatively large denomination chips. For example, three chips each denominated as five dollar value chips are substituted with one twenty-five dollar value chip. Substitution of chips and increasing the maximum and minimum bets are preferably done at selected times at regular intervals throughout the tournament games, and these regular intervals may, for example, take place every hour. These changes in effect hasten the depletion of the players' game chips in addition to advancing the games toward more a more high stakes type of game that enhances both player and spectator excitement. Moreover, since television shows typically do not attract much viewer interest if the shows are long in duration and have to count on the typical viewer having a long attention span, hastening the depletion of the players' game chips shortens the tournament games thereby making them more suitable for television broadcasting.

A predetermined number of players are the final winners and are awarded the tournament pool or prize according to their relative placing at the time of termination of the tournament. The predetermined number is typically three to eight but may vary depending on the total number of participants at the commencement of the games, amount of the jackpot, whether the desired duration of the games is to be long or short, etc. The tournament winner placings (or order of placement) i.e., for example, the number one, number two and number three winners, are typically determined according to the order in which the final players drop out of the tournament games. The tournament pool distribution is based on a percentage of the total amount of money in the pool. For example, when the predetermined number of final winners is three, normally and officially the number one winner is awarded sixty percent of the pool, the number two winner is awarded thirty percent of the pool and the number three winner is awarded ten percent of the pool. The amount of the pool typically includes the sum total of the entry fees paid minus a service charge and sometimes includes a contribution from the casino holding the tournament. The casino contribution is made in order to increase the amount of the pool to a level deemed likely to attract tournament participation.

Accordingly, there has been provided, in accordance with the invention, a method for organizing and conducting a poker tournament which enhances spectator as well as participant interest and involvement and thus fully satisfies the objectives set forth above. It is to be understood that all terms used herein are descriptive rather than limiting. Although the invention has been specifically described with regard to the specific embodiment set forth herein, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

I claim:

1. A card game tournament method, comprising:

providing players for the tournament;

dividing the players into first groups, members of each of said first groups playing individual card games of a desired type of card game with each other and declaring winners and losers, each of said first groups having a total number comprising a multiplicity of player members;

eliminating a player from one or more of said first groups if declared a loser leaving a new total number of players;

discontinuing the individual card games when the total number of players of said first groups declines to a selected number greater than two due to losers of said individual card games dropping out of the tournament, the selected number also being a product of two;

dividing remaining players of the first groups into second groups for playing individual card games of the same desired type of card game between player members of each of said second groups, each of said second groups consisting of solely a pair of player members;

recommencing the individual card games of the same desired type of card game with the player members of each of said second groups playing the individual card games with each other;

eliminating a player from one or more of said second groups if declared a loser leaving a new total number of players;

terminating the tournament games when there is at least one winner of the individual card games.

2. The method of claim 1 further including matching up initial ones of the Winners of the card games within each of said second groups with each other into new groups of said second groups, each of said new groups consisting of a pair of said initial winners.

3. The method of claim 2 further including matching up successive ones of the winners of the card games with each of said new groups of said second groups with each other into successive groups of said second groups, each of said successive groups consisting of a pair of said successive winners.

4. The method of claim 1 wherein the exponential product of two is selected from a set of numbers which include the numbers four, eight, sixteen, thirty-two, sixty-four and one hundred and twenty-eight.

5. The method of claim 1 wherein the desired type of card game is poker.

6. The method of claim 1 further including awarding money pool to a plurality of winners of said second groups remaining at termination of the tournament card games after the losers have dropped out.

7. The method of claim 6 wherein a value of a portion of the money pool awarded to the plurality of winners is based on an order of placement of the prevailing of winners at termination of the tournament games.

8. The method of claim 1 wherein the card game is a wagering game and further including the step of increasing minimum betting requirement at selected times in the individual card games.

9. The method of claim 8 wherein the selected times for increasing the minimum betting requirement occurs at regular intervals.

10. The method of claim 1 wherein the card game is a wagering game and further including the step of providing each of the players with a selected amount of game chips so that the value of the game chips provided each one of the players is equal to that provided each other of the players to equalize the players' chances of winning the tournament games.

11. The method of claim 1 further including selecting the initial ones of the winners of the first group during the step of dividing according to total number of chips in possession of each one of the initial ones of the winners at the time of winning relative to that of each other of the initial ones of the winners at the time of winning.

12. The method of claim 11 wherein the selecting of the initial ones of the winners includes matching up winners with total number of chips relatively higher than that of the other winners with winners with total number of chips relatively lower than that of the other winners.

13. The method of claim 1 wherein the step of includes eliminating those players whose chips have declined to zero.

14. The method of claim 1 wherein the card game is a wagering game and further including selecting players in succession based on seating arrangement thereof relative to each other for initiation of betting in each individual card game.

15. The method of claim 1 wherein the card game is a wagering game and further including exchanging chips of smaller denomination than others of those used in the card games with chips of larger denomination at selected times in the tournament.

16. The method of claim 15 wherein the exchanging of chips occurs at regular intervals.

17. The method of claim 1 wherein the total number of players in each of said first groups is selected from a set of numbers including seven, eight, nine and ten.

18. The method of claim 1 wherein the card game is a wagering game further including increasing maximum betting limits at selected times in the tournament.

19. The method of claim 18 wherein the increasing of maximum betting limits occurs at regular intervals.

20. The method of claim 1 further including removing players in ones of the first groups out of other ones of the first groups and transferring the players to other ones of the first groups when a total number of players in the ones of the first groups has declined below a predetermined minimum in order to generally equalize the number of players in the first groups.

* * * * *